United States Patent [19]

Yoon

[11] Patent Number: 4,951,320

[45] Date of Patent: Aug. 28, 1990

[54] INNER RIM OF A CAP

[76] Inventor: Cheong-Sook Yoon, Jugong Apt. 120-101, Kajwa-dong, Buk-ku, Inchin-City, Rep. of Korea

[21] Appl. No.: 290,871

[22] Filed: Dec. 30, 1988

Related U.S. Application Data

[63] Continuation of Ser. No. 832,679, Feb. 25, 1986, abandoned.

[51] Int. Cl.[5] ..... A42B 1/00

[52] U.S. Cl. ..... 2/181.2; 2/209.3; 2/171.3; 2/197; 2/182.6; 2/DIG. 11

[58] Field of Search ..... 2/181.2, 181, 181.4, 2/182.3, 183, 185 B, DIG. 11, 171.3, 209.7, 182.5, 182.6, 171.2, 12, 171, 171.1, DIG. 6, 209.3, 209.4

[56] References Cited

U.S. PATENT DOCUMENTS

| | | | |
|---|---|---|---|
| Re. 22,073 | 2/1942 | Szumkowski | 2/182.1 |
| 107,173 | 11/1870 | Warburton | 2/182.1 |
| 171,103 | 12/1875 | Dillaway | 2/209.7 |
| 174,998 | 3/1876 | Abbott | 2/209.7 |
| 1,140,812 | 5/1915 | Getler | 2/183 |
| 1,187,507 | 6/1916 | Cayne | 2/182.6 |
| 1,715,201 | 5/1929 | Levin | 2/183 |
| 2,249,145 | 7/1941 | Kraft | 128/76 R |
| 2,832,077 | 4/1958 | McGinnis | 2/181.2 |
| 2,855,202 | 10/1958 | Kinne | 128/76 R |
| 3,548,416 | 12/1970 | Bloom | 2/180 |
| 4,011,600 | 3/1977 | Malk | 2/183 |
| 4,023,212 | 5/1977 | Huffman | 2/197 |
| 4,101,981 | 7/1978 | Boden | 2/182.6 |
| 4,274,157 | 6/1981 | Boden | 2/197 X |
| 4,481,681 | 11/1984 | Hankin | 2/183 |

FOREIGN PATENT DOCUMENTS

| | | | |
|---|---|---|---|
| 884067 | 7/1953 | Fed. Rep. of Germany | 2/181 |

OTHER PUBLICATIONS

Gershman, J. A. M. A., "Self Adhering Nylon Tapes", vol. 168, No. 7, p. 980, 10-1958.

*Primary Examiner*—Peter Nerbun

[57] ABSTRACT

An inner rim of a cap comprising a flat band having a hair contact portion and a forehead portion, a plurality of semi-rigid projecting members disposed on the inside surface of the hair contact portion of the flat band, a forehead supporter disposed on the front forehead portion of the inside surface of the flat band, and a fastener member disposed at both ends of the flat band.

7 Claims, 2 Drawing Sheets

INNER RIM OF A CAP

This application is a continuation of application Ser. No. 832,679 filed on Feb. 25, 1986, now abandoned.

BACKGROUND OF THE INVENTION

The present invention relates to an inner rim of a cap, and more particularly to a rim of a cap which contains a plurality of projecting members disposed at the interior thereof for preventing the head from being pressed by a flat rim of the cap which is worn.

Various designed inner rims of caps are well known. It is also known that the inner rims of caps comprise a plain synthetic resin band and a strap made of cotton to fit the cap to the head. One type of cap has a ventilation aperture on the plastic band to ventilate the air into the cap. However, one disadvantage of these types of inner rims is that it presses the head through the flat plastic band causing it to fit tightly around the head. Furthermore, caps having a flat inner rim easily slip off due to the wind.

OBJECTS AND SUMMARY OF THE INVENTION

Accordingly, it is an object of the present invention to provide an improved inner rim of a cap containing a plurality of projecting members disposed on the inner surface thereof.

Another object of the present invention is to provide a plurality of projecting members disposed at an inner side of a band for preventing the head from being pressed by a flat band.

A further object of the present invention is to provide an inner rim containing multi-projecting members at an inner side for preventing the cap from slipping off the head.

Still another object of the present invention is to provide an inner rim of a cap which has a plurality of projecting members disposed at the interior of a flat band so that the inner rim forms a plurality of ventilation apertures when the cap is worn.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention is directed to an inner rim of a cap which contains a plurality of projecting members disposed at the interior surface of a flat band for preventing the head from being pressed by the band of the cap and the cap from slipping off from the head. Also, the inner rim of the present invention provides air ventilation circulating air into the cap.

BRIEF DESCRIPTION OF THE DRAWINGS

The present invention will become more fully understood from the detailed description given hereinbelow and the accompanying drawings which are not given by way of illustration only, and thus are not limitative of the present invention, and wherein.

DETAILED DESCRIPTION OF THE DRAWINGS

Figure 1:
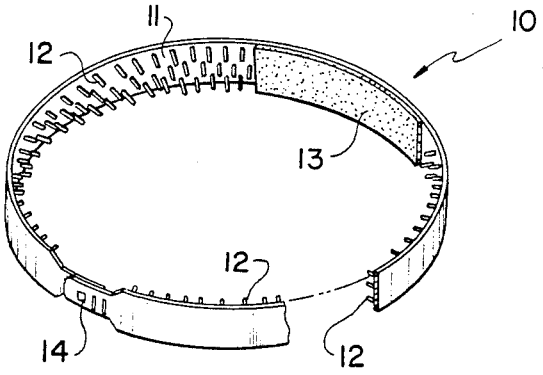
FIG. 1 is a perspective view of an inner rim of the present invention.
Figure 2:
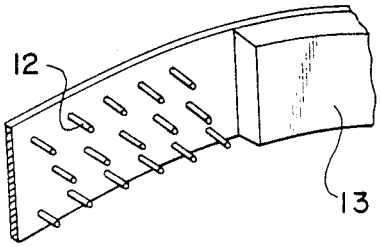
FIG. 2 is a perspective view of a part of an inner rim of FIG. 1.
Figure 3:
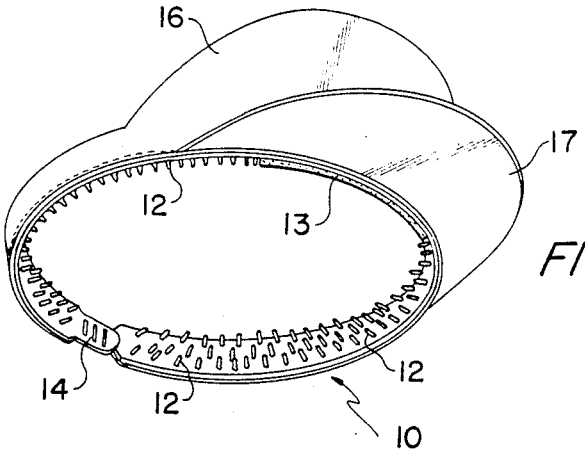
FIG. 3 is a perspective view of an inner rim of a cap of the present invention.
Figure 4A:
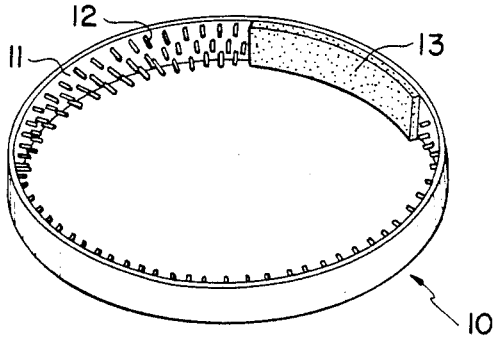
FIG. 4A is a perspective view showing an inner rim without a fastener.
Figure 4B:
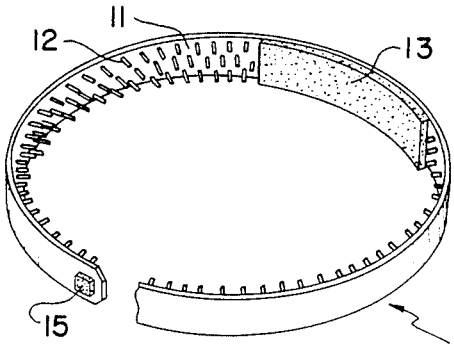
FIG. 4B is a perspective view showing an inner rim having a hook-type fastener according to the present invention.

Referring now in detail to the drawings for the purpose of illustrating the present invention, a flat band 10 as shown in FIGS. 1 and 3 comprises a plurality of projecting members 12 disposed on an inside surface 11 thereof, a forehead supporter 13 disposed on the inside surface 11 thereof and a locking member 14 disposed at an opposite side of the forehead supporter 13 thereof. The plurality of projecting members are arranged along the inside surface 11 of the flat band 10 in lengthwise, staggered rows. The height of the projecting member 12 is about 1 to 3 mm. The end of the plurality of projecting members 12 are rounded in a very smooth manner for preventing injury to the head. Also, the height of the projecting members are the same as that of the forehead supporter 13. The forehead supporter 13 of the present invention is disposed within a front brim 17 of a cap 16. The plurality of projecting members disposed on the inside surface 11 of the rim 10 should not contact the forehead to avoid discomfort or injury to the forehead by the projecting members 12. A fastener 14 shown in FIG. 1 is a locking type whereas the fastener 15 shown in FIG. 4B is a hook type (Velcro). FIG. 4A shows an inner rim 10 of the present invention which does not have any fasteners. As shown in FIG. 3, the inner rim having a plurality of projecting members 12 of the present invention is attached to the rim of the cap 16. In this arrangement, the forehead supporter 13 is positioned at the front brim 17 of the cap 16.

Thus, the inner rim 10 of the cap 16 of the present invention has a plurality of projecting members 12 at the inside surface 11 thereof which eliminates the pressure of a flat band on the head, provides a secure fit on the wearer and forms ventilation apertures between the inside and the outside of the cap. The inner rim 10 also provides a therapeutic effect on the scalp by the gentle massaging caused by the projecting members 12.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An inner rim of a cap comprising a band having parallel inner and outer surfaces and a forehead portion, a plurality of spaced scalp massaging rigid projecting members extending from said inner surface of said band only at locations other than said forehead portion, said plurality of rigid projecting members being disposed in rows which are arranged longitudinally along said band, said rows being staggered relative to each other for preventing the hairs from being contacted directly by said band, whereby said scalp massaging rigid projecting members provide a therapeutic effect on the scalp by direct massaging caused by the contact made by said rigid projecting members with the scalp, said spaced rigid projecting members providing for the passage of some air therebetween for ventilation purposes, a forehead supported disposed at said forehead portion on said inner surface of said band, said forehead supporter having a single continuous inner surface for engagement with a forehead of a human body and a single continuous outer surface parallel to said continuous inner surface, said continuous outer surface of said forehead supporter being parallel to said inner surface of said band and attached directly thereto, and fastener means for forming said band into a substantially circular form whereby said band may be worn upon a human head.

2. The inner rim of the cap of claim 1 wherein the height of said projecting members is about 1 to 3 mm.

3. The inner rim of the cap of claim 2 wherein the height of said projecting members is the same as the height of the forehead supporter.

4. The inner rim of the cap of claim 1 wherein the fastener member is of the locking type.

5. The inner rim of the cap of claim 1 wherein the fastener member is of the hook-type.

6. The inner rim of a cap of claim 1 wherein said rigid projecting members are located to substantially encompass said band with the exception of said forehead portion.

7. A cap containing an inner rim comprising a band attached to the inside of the cap, said band having parallel inner and outer surfaces and a forehead portion, a plurality of spaced scalp massaging rigid projecting members extending from said inner surface of said band only at locations other than said forehead portion, said plurality of rigid projecting members being disposed in rows which are arranged longitudinally along said band, said rows being staggered relative to each other for preventing the hairs from being contacted directly by said band, whereby said scalp massaging rigid projecting members provide a therapeutic effect on the scalp by direct massaging caused by the contact made by said rigid projecting members with the scalp, said spaced rigid projecting members provide for the passage of some air therebetween for ventilation purposes, a forehead supported disposed at said forehead portion on said inner surface of said band, said forehead supporter having a single continuous inner surface for engagement with a forehead of a human body and a single continuous outer surface parallel to said continuous inner surface, said continuous outer surface of said forehead supporter being parallel to said inner surface of said band and fastened thereto, and fastener means for forming said band into a substantially circular form whereby said band may be worn upon a human head.

* * * * *